United States Patent [19]

Herron

[11] Patent Number: 4,520,734

[45] Date of Patent: Jun. 4, 1985

[54] SHORT DISPLACEMENT DOUBLE ACTING VEHICLE SUSPENSION SYSTEM

[75] Inventor: Charles R. Herron, Bluefield, Va.

[73] Assignee: Baker International Corp., Orange, Calif.

[21] Appl. No.: 524,002

[22] Filed: Aug. 17, 1983

[51] Int. Cl.[3] ..... B61F 5/16; B61F 5/30

[52] U.S. Cl. ..... 105/157 R; 105/136; 105/218 R; 105/224 R; 280/112 R; 403/122; 403/158

[58] Field of Search ..... 280/112 R, 112 A, 111, 280/109, 703, 715, 81 A, 81 R; 105/157 R, 136, 218, 224, 80; 267/57 R; 308/2 R; 403/131, 135, 157, 158, 122

[56] References Cited

U.S. PATENT DOCUMENTS

| | | | |
|---|---|---|---|
| 4,085,682 | 4/1978 | Nelson et al. | 105/157 R |
| 4,213,399 | 7/1980 | DeBrick | 105/157 R |
| 4,243,192 | 1/1981 | Johnson | 403/158 X |

FOREIGN PATENT DOCUMENTS

| | | | |
|---|---|---|---|
| 662493 | 7/1938 | Fed. Rep. of Germany | 403/157 |

*Primary Examiner*—Joseph F. Peters, Jr.

*Assistant Examiner*—Mitchell J. Hill

*Attorney, Agent, or Firm*—Carl A. Rowold

[57] ABSTRACT

An axle assembly has a longitudinal pivotal connection to a vehicle frame enabling it to rock about a longitudinal axis extending generally longitudinally of the direction of movement of the vehicle. One of the fore-and-aft ends of the axle assembly is hinged to the frame by a universal joint connection consisting of a ball and socket enabling completely unrestricted tilting, swinging and rocking movement of the axle assembly in all directions relative to the frame. At the opposite end, the axle assembly is freely tiltable up and down about a connection to the frame enabling free vertical movement of the tiltable end of the axle assembly while restraining horizontal movement. Springs support the vehicle frame at opposite sides of the axle assembly. Shocks applied through wheels on the axle assembly are absorbed by unrestricted rocking movement of the axle assembly about the longitudinal axis accompanied by up and down tilting movement, both of these movements being about the universal joint connection within a range permitted by the springs. The invention is applicable to non-railway vehicles, as well as to the railway type vehicles shown.

5 Claims, 7 Drawing Figures

SHORT DISPLACEMENT DOUBLE ACTING VEHICLE SUSPENSION SYSTEM

BACKGROUND OF THE INVENTION

The invention relates to suspensions for vehicles for cushioning shocks on an axle assembly caused by irregularities in the track or ground before they can be transmitted to the vehicle frame.

Personnel, and some supplies, are transported about underground mines in battery- or trolley-powered personnel cars, sometimes called jeeps or portal buses, having flanged railway-type wheels running on mine track. Most mine track undulates because it is not economical to install it with above-ground precision or to prepare a deep, stable foundation for it. Once installed, the track condition worsens in use because of irregular heaving or swelling of the mine bottom, roof falls, and the constant back and forth shuttling of mine cars and locomotives. It is not unusual in a modern large mine for miners to be transported in personnel cars as much as three to five miles between the entry and their working places. This can require a ride of up to an hour at the beginning and end of the shift, during which time the miners are confined to the car, often in prone or crouched positions to clear the roof and supporting beams.

Up to a few years ago, miners were transported in empty mine cars or shuttle cars. Sometimes they walked, or even crawled part way. Use of mine cars, locomotives, and shuttle cars for this use diverted production machinery from its primary purpose; further, cars made for hauling and dumping coal and ore were not comfortable and sometimes not even safe. Occasionally, to go between working areas during a shift, a few miners would hitch a ride on the top of a locomotive or in a mine car. It has been only recently that special cars have been made primarily for transporting personnel. They have been manufactured primarily for safety with comfort features such as cushioning and roominess secondary. In some personnel cars, one or more axles are trunnion-mounted, rocking about longitudinal pivotal connections to the frame at the center of the car. This eliminates the requirement for journal boxes and allows the cars to adapt to varying track conditions and negotiate curves without derailment. It saves cost and in some cases lowers head room requirements. However, although the trunnion mount enables the axle assembly to rock about pivotal connections to accommodate up and down irregularities in the track or ground, the pivotal connections fore and aft of the axle housing have been solidly connected to the frame and transmitted shocks, uncushioned, directly from the axle assembly to the frame and to the miners riding inside. Even though some cushioning results from rocking the axle assembly upward against springs, this can be most uncomfortable on a long trip underground.

The early personnel cars were substantially improved by the development of a rocking hinge-type suspension. This was similar to the trunnion-mounted suspension described in the above paragraph except that one of the trunnion swivel blocks swung upwardly against springs. Two examples of this construction are shown in U.S. Pat. No. 4,085,682 issued Apr. 25, 1978 to Robert C. Nelson et al, and U.S. Pat. No. 4,213,399 issued July 22, 1980 to Eric DeBrick. These represented substantial improvements. They provided a relatively short up and down displacement of the vehicle frame for advantageous use in low headroom mines, yet provided double acting shock absorption, first by rocking the axle assembly about a longitudinal axis through trunnions as previously described and, in addition, tilting the axle assembly up and down about a hinged end. Springs absorbed shocks from both tilting and rocking movements. Rider comfort was improved, especially on long trips. However, these suspensions had some limitations which prevented them from fully exploiting the rocking hinge principle.

The suspension in U.S. Pat. No. 4,085,682 would not tilt up and down unless the axle was first moved to a nearly horizontal position. As a result, at any moment when the axle assembly was rocked out of a horizontal position, vertical tilting about the hinged end had to be preceded by rocking the axle assembly to or near a horizontal position. This created wear and communicated shock to the riders.

The suspension in U.S. Pat. No. 4,213,399 was developed primarily for locomotives. A special connecting means was provided between the vehicle frame and the axle assembly at the hinged end. This did not permit unrestricted sidewise swinging movement of the axle assembly to accommodate sidewise movement at the tiltable end in case excessive clearance existed there.

In both prior art constructions illustrated by the above-mentioned patents, the relatively movable parts at the hinged end must be made with substantially more clearance than is desirable to prevent binding and shock transmission to riders; if such excessive clearance were not provided when the vehicle was manufactured, the parts would wear that way in use.

SUMMARY OF THE INVENTION

It is a general object of the present invention to provide a shock absorbing articulated jointed suspension of the rocking hinge type to cushion shocks transmitted from a vehicle wheel to its frame, with limited up and down motion of the frame.

Another object is to provide a rocking hinge type suspension in which the axle assembly is unrestrictedly free to rock about a longitudinal axis, and tilt up and down and swing sidewise about a hinged connection, without requiring that excessive clearance be provided between relatively movable components of the hinged connection.

Another object is to provide such a suspension in which the axle assembly can be manufactured with a high degree of precision and with close-fitting parts in the hinged connection without causing binding and excessive wear.

Another object is to provide such a suspension in which the axle assembly is freely tiltable up and down at all rocked positions thereof.

Another object is to provide such a suspension in which the axle assembly is freely swingable from side to side to accommodate any degree of clearance that may exist by design or wear at the tiltable end.

Another, more specific, object is to provide an improved rocking hinge type suspension with a universally movable ball and socket connection between the axle assembly and the vehicle frame at the hinged end, and a cam and vertical guide connection at the tiltable end.

BRIEF DESCRIPTION OF THE DRAWINGS

Other objects and advantages will be apparent from the following description taken in connection with the accompanying drawings in which.

Like parts are referred to by like reference characters.

DESCRIPTION OF THE PREFERRED EMBODIMENT

Figure 1:
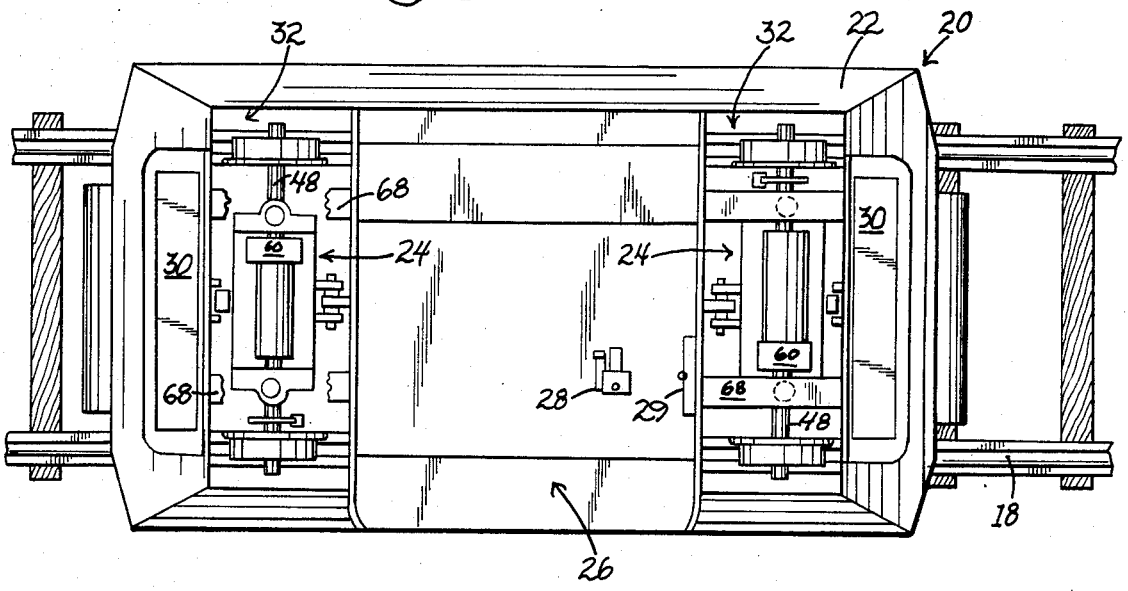
FIG. 1 is a top plan view of an underground mine personnel carrier illustrating the present invention as applied to one specific type of vehicle.
Figure 2:
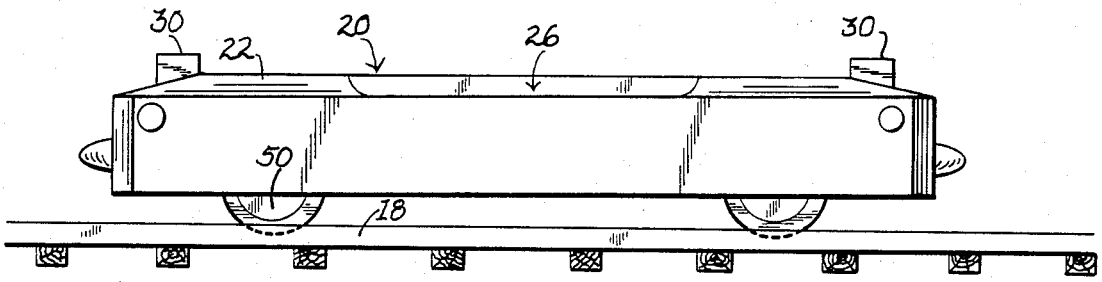
FIG. 2 is a side view of FIG. 1.
Figure 3:
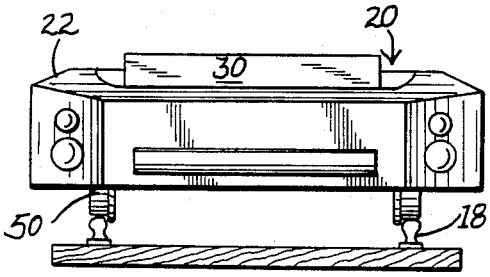
FIG. 3 is an end view of FIG. 1.

The vehicle chosen to illustrate the invention, generally designated 20, is a mine personnel car or jeep. It runs on railway type tracks 18. One of the major current applications of this invention is to transport personnel into and about underground coal mines.

The vehicle has a frame or body 22 mounted on a pair of axle assemblies 24 by suspension means which is the subject of the present invention. The frame illustrated is conventional and will not be described in detail. Briefly, however, it includes a personnel compartment 26. The particular vehicle shown is a low unit having an overall height of twenty-two to twenty-four inches so miners riding in it must take reclining positions to clear the roof and roof-supporting structures. Batteries 30 at opposite ends supply electrical power to a tramming motor 58. Brake and tramming controls 28 and 29 may be conventional.

The terms "longitudinal" and "transverse" and their adverbial forms used in this description and in the claims will refer to horizontal directions which are generally parallel to the direction of movement of the vehicle and generally transverse thereto, respectively. For example, each of the two axle compartments 32, 32 in the frame are defined by a pair of "transverse" vertical wall plates 34 and 36. And they are "longitudinally" spaced, meaning they are spaced apart along the longitudinal axis of the vehicle.

Other than the brake and tramming controls 28 and 29 which are schematically illustrated, the personnel compartment 26 is shown without controls because they comprise no part of the present invention. It will be understood that because the vehicle is reversible, either end will be the "front" or "rear" depending on the direction of travel. Because the personnel compartment is midway between the ends of the vehicle, the operator can readily see either way and control movement in either direction.

Referring now to the axle assembly 24, this comprises a rectangular housing 38, open at the top and bottom, and a pair of horizontal plates 40, 40 attached as by welding at 42. An upwardly open spring retaining cup 44 is fastened as by welding 46 to the top of each plate. An axle 48, with flanged wheels 50 is rotatably journaled in bearing members 52 affixed by bolts 54 to the ends of the housing 38. The wheels 50 run on rails 18.

Figure 4:
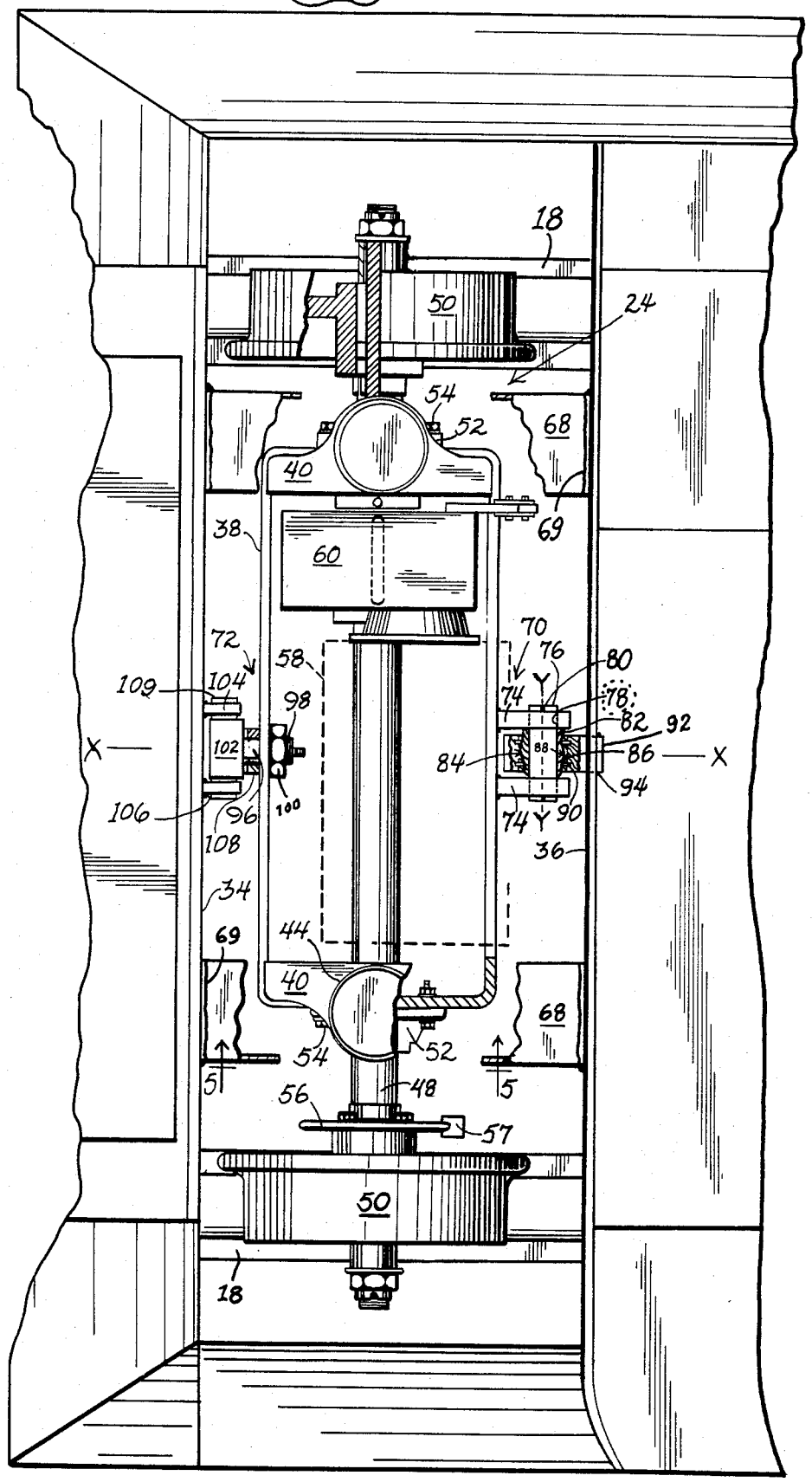
FIG. 4 is a fragmentary enlarged view of FIG. 1.
Figure 5:
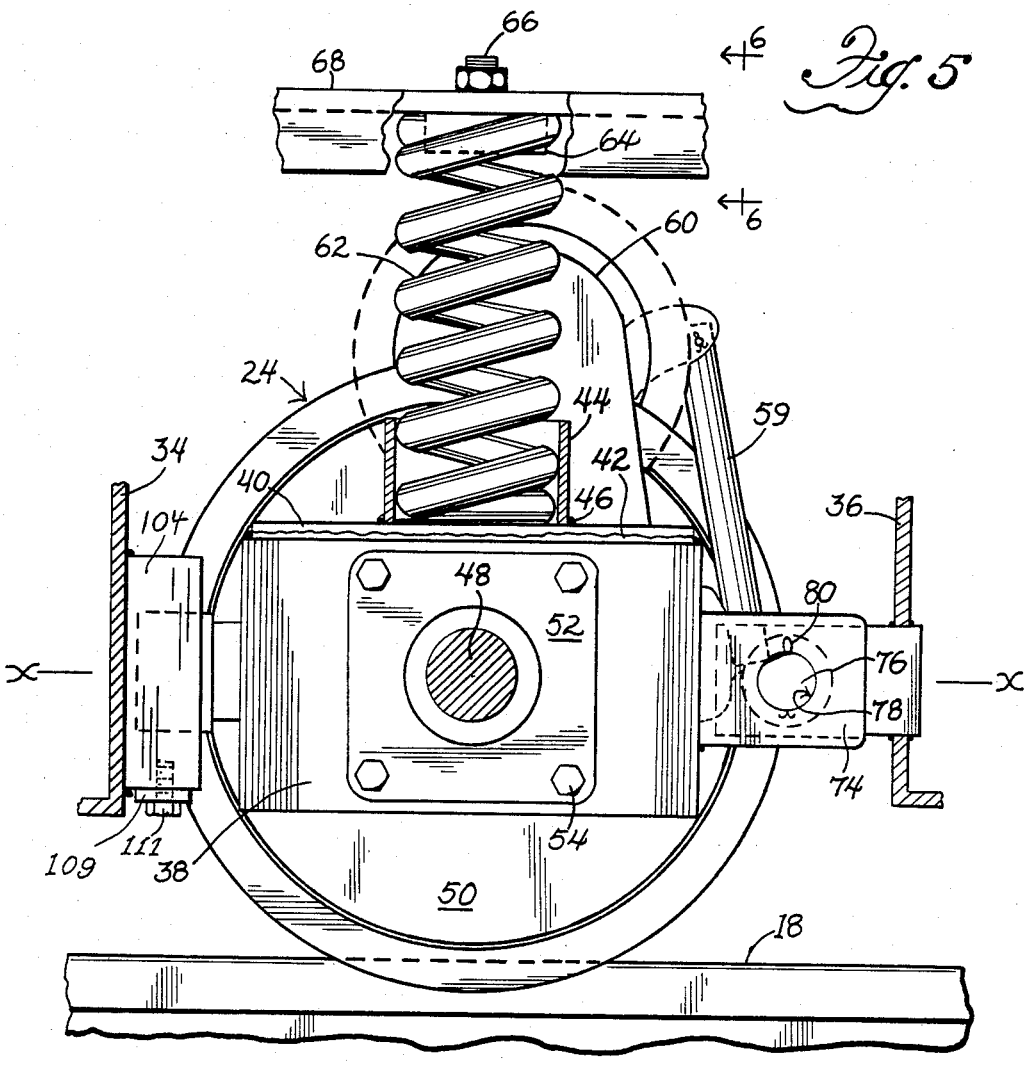
FIG. 5 is a fragmentary vertical sectional view of FIG. 4 taken in the direction of the arrows 5—5.

Electric motor 58 is shown in phantom in FIGS. 4 and 5. This drives the axle 48 through a transmission 60. Each axle has a brake disc 56 with compression calipers 57 actuated by means not shown. A torque arm link 59 is connected between the axle housing 38 and the transmission 60.

A pair of compression coil springs 62 are seated within the retaining cups 44. Spring retainer plugs 64 are held by bolts 66 on longitudinally extending angle iron members 68 which are fastened as by welding at 69 across the tops of plates 34 and 36. The springs are thus carried between the frame 22 and the axle assembly 24 at opposite sides thereof. Each spring 62 is deflectable in a vertical direction under loads applied to the spring by the axle assembly 24, with the line of action of the spring being generally through the axle 48.

Suspension means whereby the axle assembly 24 is pivotally mounted relative to the vehicle frame about separate transverse and longitudinal axes respectively is the subject of the present invention. This will now be described.

The axle assembly has a hinged end generally designated 70 and a tiltable end generally designated 72.

A universal joint connection between the vehicle frame and the hinged end of the axle assembly consists of a ball and socket arrangement which enables completely free and unrestricted movement of the axle assembly in three different directions as follows: up and down tilting movement about transverse axis Y—Y; rocking movement about longitudinal axis X—X; and sidewise swinging movement to the extent allowable by any horizontal clearance at the tiltable end of the axle assembly.

Figure 7:
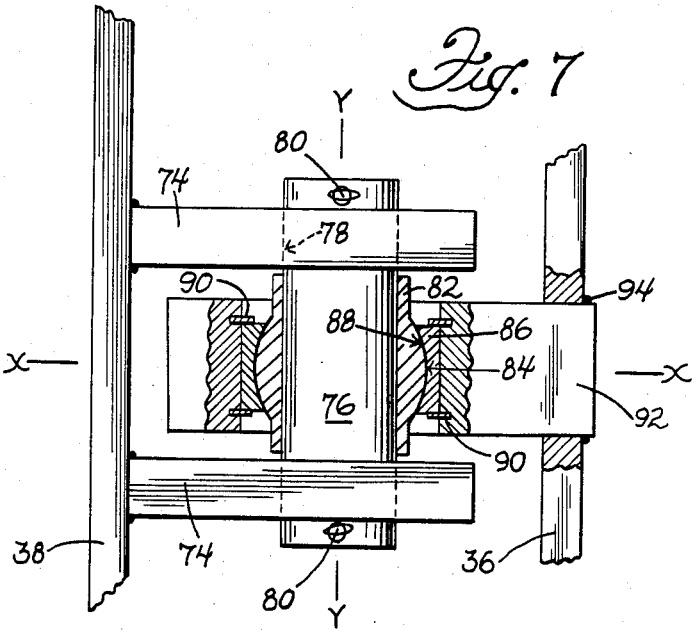
FIG. 7 is a fragmentary enlarged view of FIG. 4.
Figure 6:
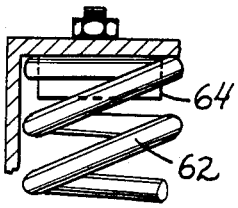
FIG. 6 is a fragmentary view of FIG. 5 taken in the direction of the arrows 6—6.

In the example shown, as best shown in FIG. 7, the connecting means at the hinged end consists of two vertical, horizontally spaced lugs 74 supporting a pin 76 in bores 78. The pin is held by cotter pins 80. A sleeve 82 with a spherical outer surface 84 is supported on pin 76 between lugs 74. A sleeve 86 with an inner spherical surface 88 engaging outer spherical surface 84 is retained by snap rings 90 within a hinged post 92. The latter is mounted as by welding at 94 in wall 36.

At the opposite, tiltable end of the axle assembly, there is a shaft 96 which extends through an opening in the rectangular housing 38 and has an inner threaded end portion 98 held in place by a nut 100. At the outer end of the shaft 96 is a cam follower roller 102 positioned between a pair of horizontally spaced vertical guide members 104 fastened as by welding 106. In the embodiment shown, the outer end of shaft 96 is provided with a spacer 108, and cam follower 102 is preferably a separate cylindrical element rotatably journaled on the shaft by bearing means not shown. A retainer plate 109 is fastened as by cap screws 111 across the undersides of vertical guide members 104. This limits downward tilt of the axle assembly and prevents loss of springs 62 from cups 44 under rough track conditions.

The center of the cam follower roller 102 and the center of the spherical surfaces 84 and 88 are positioned along the longitudinal axis X—X.

By the structure above described, the load of the vehicle frame will be applied to each axle assembly 24 through three points consisting of the springs 62, 62 and the ball and socket members 82, 86. The ball and socket joint, of course, permits no relative up and down movement between the hinged end of the axle assembly and the frame. However, the springs 62 do enable some cushioned, relative vertical movement in two ways: first, when the axle assemble tilts up and down about the hinged end 70; and second, when it rocks about the axis X—X. Thus, under stable load conditions, such as occurs when the vehicle is traveling over flat, regular track, substantially the entire weight of the frame is borne by the springs. However, when shocks are applied to the axle assembly, such as occur when the vehicle is traveling over irregular track, the springs and the hinged and tiltable connections support the frame.

In operation, as the vehicle moves along tracks 18, the axle assembly 24 will rock sidewise about the longitudinal axis X—X. This cushions the body against shock and twisting caused by the kind of undulations in which the track levels change individually, for example, where there is a sudden rise or sag in one track but not the other. Rocking of the axle assembly about axis X—X absorbs shock ideally where the track surfaces undulate but their average remains the same. As a practical matter, this ideal situation seldom occurs, because level changes almost always affect both tracks differently, so a raise in one track seldom if ever precisely cancels out an identical drop in the other. In other words, the average level changes constantly. For absorbing this kind of shock, the up and down tilt about transverse axis Y—Y (through the ball and socket joint) is most effective. A sudden lift, where both ends of the axle assembly abruptly rise at the same time, causes upward movement of the cam follower 102 between guide members 104, at a rate determined by the strength of the springs 62, and cushions the impact transmitted to the vehicle frame and to the personnel inside.

The improved suspension of the present invention permits completely free and unrestricted movement of the axle assembly in three ways. *First,* it tilts up and down about transverse axis Y—Y regardless of its rocked condition, whether it be perfectly level or severely rocked; *second,* it rocks freely about the axis X—X regardless of its tilted position, whether high or low; and *third,* it is free to shift sidewise, obviating the necessity of precisely aligning the hinged and tiltable ends 70 and 72 along the longitudinal centerline of the vehicle. The horizontal clearance between the cam follower 102 and guides 104 will preferably be very small. This, coupled with the rolling contact of the cam on the guide surfaces greatly reduces sidewise impact and wear. This construction has resulted in a substantially improved ride for people required to go into and about underground mines. It is especially advantageous where head room is at a minimum preventing the use of conventional, cushioned suspension systems involving up and down vehicle body movement of substantial magnitude.

While one preferred embodiment of the improved shock absorbing vehicle suspension has been shown and described, it will be apparent to those skilled in the art that other specific constructions and arrangements are possible within the spirit and scope of the invention as covered by the following claims.

The embodiments of the invention in which an exclusive property or privilege is claimed are defined as follows:

1. In a vehicle, a frame, an axle assembly having an axle housing with a wheel supporting axle rotatably journaled therein, wheels at the ends of said axle, improved short displacement double acting ride suspension means comprising:

separate connecting means, at fore-and-aft ends of the axle assembly, enabling rocking movement of the axle assembly relative to the frame about a longitudinal axis extending generally longitudinally of the direction of movement of the vehicle;

one of said fore-and-aft ends of the axle assembly being a hinged end and the other being a tiltable end;

the connecting means at the hinged end of the axle assembly including a universal joint connection to the frame enabling unrestricted tilting, swinging and rocking movement of the axle assembly about the universal joint connection in all directions with respect to the frame;

the connecting means at the tiltable end of the axle assembly including first and second interengaging guide means on the axle assembly and frame respectively enabling free vertical movement of said tiltable end of the axle assembly while restraining horizontal movement thereof; and a pair of springs carried between the frame and the axle assembly at opposite sides thereof, each spring being deflectable in a vertical direction under loads applied to the spring by the axle assembly, with the line of action of the spring being generally through the axle, whereby under stable load conditions, such as occur when the vehicle is traveling over flat, regular track, substantially the entire weight of the frame bearing on the axle assembly is borne by the springs and when shocks are applied to the axle assembly, such as occurs when the vehicle is traveling over irregular track, the springs acting together with the connecting means support the frame; and the springs and the universal joint connection thus provide a stable, cushioned, three-point support for the frame; whereby shocks applied to the axle assembly through the wheels are absorbed by unrestricted rocking movement of the axle assembly about said longitudinal axis accompanied by up and down tilting movement of the axle assembly about said universal joint connection within a range permitted by said springs.

2. In a vehicle, improved ride suspension means according to claim 1 in which:

said universal joint connection comprises a ball and socket.

3. In a vehicle, improved ride suspension means according to claim 1 in which:

said first and second interengaging guide means comprises a cam follower positioned between a pair of horizontally spaced vertical guides.

4. In a vehicle, improved ride suspension means according to claim 3 in which said cam follower is circular in cross section enabling said axle assembly to rock from side to side while the tiltable end thereof is guided for concurrent vertical movement relative to the frame.

5. In a vehicle, improved ride suspension means according to claim 4 in which said cam follower is rotatably mounted so as to be in rolling engagement with the vertical guides.

* * * * *